US006412916B1

(12) United States Patent
Okano et al.

(10) Patent No.: US 6,412,916 B1
(45) Date of Patent: Jul. 2, 2002

(54) INK JET PRINTER

(75) Inventors: Mamoru Okano; Atsushi Onose; Shigetaka Fujiwara; Yoshinobu Fukano; Seiji Yonekura; Yoshiharu Nagae, all of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/582,516

(22) PCT Filed: Jan. 9, 1998

(86) PCT No.: PCT/JP98/00057

§ 371 (c)(1),
(2), (4) Date: Jun. 27, 2000

(87) PCT Pub. No.: WO99/34982

PCT Pub. Date: Jul. 15, 1999

(51) Int. Cl.[7] ..... B41J 2/06
(52) U.S. Cl. ..... 347/55
(58) Field of Search ..... 342/55, 151, 120, 342/141, 154, 103, 123, 111, 159, 127, 128, 131, 125, 158; 399/271, 290, 292, 293, 294, 295

(56) References Cited

FOREIGN PATENT DOCUMENTS

WO WO 93/11866 * 6/1993 ..... 347/55

* cited by examiner

*Primary Examiner*—Raquel Yvette Gordon
(74) *Attorney, Agent, or Firm*—Antonelli, Terry, Stout & Kraus, LLP

(57) ABSTRACT

An ink jet printer is of a small size and is capable of printing high-quality images, wherein an ink with a colorant dispersed in a solvent is ejected in a direction lower than a horizontal level and is adhered to a surface of a recording medium. The recording medium is conveyed while being spaced a constant distance from ink ejecting electrodes, thereby stabilizing an electric field induced between the ink ejecting electrodes and the recording medium and stabilizing the amount of the ink ejected.

12 Claims, 9 Drawing Sheets

INK JET PRINTER

TECHNICAL FIELD

The present invention relates to an ink jet printer; and, more particularly, the invention relates to a structure of a printing head and an ink circulating method.

BACKGROUND OF THE INVENTION

An ink jet printer is known wherein ink droplets are ejected each in a small quantity from a very small ink ejecting portion and are deposited on a recording medium to form dots, allowing an image to be printed by a gathering of those dots. According to the configuration of such an ink jet printer, ink is conducted to the ink ejecting portion, in which a kinetic energy is imparted to the ink, thereby allowing an ink droplet to be ejected from the ink ejecting portion and deposited on a surface of the recording medium to form a dot. As one of the driving methods for imparting a kinetic energy to the ink, there is a known method wherein a piezoelectric element is bonded as a drive member to a part of a wall which constitutes an ink chamber, and a pulse voltage is applied to the piezoelectric element, causing the piezoelectric element to be deformed instantaneously, thereby deforming the above mentioned wall to decrease the volume of the ink chamber. Then, due to the resulting pressure, the ink is ejected from a small hole of 30 to 50 $\mu$m in diameter. For example, in Japanese Patent Laid-Open No. Hei 8-58089 there is described an ink jet printer in which the above method is used.

In the above method, since ink is ejected from a very small hole with a pressure for deforming a part of the ink chamber wall, which pressure is set to about the atmospheric pressure, there does not occur any leakage of ink even when the small hole faces downward, but there easily arises the problem that the small hole becomes clogged due to drying of a solvent contained in the ink.

As an example of a method for preventing such clogging of the ink, there is a known method wherein fine holes are not provided, but ink ejecting electrodes are arranged on an open surface and a voltage is applied between any of the ink ejecting electrodes and a recording medium, allowing an ink droplet to be ejected with an electrostatic force.

In this method, since the amount of ink to be ejected is determined according to the width of the pulse which is applied, it is possible to change the diameter of each printing dot, and, hence, an image of high definition can be printed.

As an example of the use of this method, reference is made to the method disclosed in Japanese Patent Laid-Open No. Hei 7-502218, in which an ink with a colorant dispersed at a low concentration in a solvent is fed to a surface of an ink ejecting electrode and a voltage is applied to the ink ejecting electrode to create an electric field, allowing the colorant having an electric charge to be aggregated near the ink ejecting electrode and allowing the ink to be ejected from a slit-like open surface onto a recording medium. Further, an improvement of this method is disclosed in Japanese Patent Laid-Open No. Hei 7-76506.

Ink jet printers are based on either a printing method (using a scan type head) wherein a printing head is mounted on a carriage and ink is ejected for printing while the carriage is reciprocated in directions perpendicular to a recording medium conveying direction, or a printing method (using a line type head) wherein a printing head having the same width as the width of a recording medium is fixed in position and ink is ejected for printing onto the recording medium being conveyed. In case of home or office printers, the scan type head is desirable because a small size is required before everything else, while in the case of printers for business use, the line type head is preferred because a high-speed printing is required.

SUMMARY OF THE INVENTION

In both methods disclosed in the above Japanese Patent Laid-Open Nos. 7-502218 and 9-76506, the agglomeration of ink is prevented by circulation of ink even if a slight amount of the solvent vaporizes during printing, for which reason the occurrence of ink clogging is presumed to be unlikely. However, near the ink ejecting electrodes which open into the atmosphere, the pressure and gravity are apt to cause ink to leak to the exterior due to circulation of the ink, so that how such leakage of ink can be prevented is a subject to be considered in case of circulating the ink. A simple solution is to direct the open surface upward relative to a horizontal level.

In the configuration disclosed in the above Japanese Patent Laid-Open No. Hei 7-502218, ink is fed to a row of ink ejecting electrodes arranged horizontally, and an open surface is set horizontally. In the printer of this configuration, since the amount of ink to be ejected is controlled by the pulse width of the applied voltage, it is a very important to keep the spacing between the ink ejecting electrodes and the recording medium constant, thereby to keep electric field exerted between the two constant. In the case where the ink ejecting direction is the horizontal direction, and for keeping the spacing between the ink ejecting electrodes and the recording medium constant, it is necessary that the recording medium be conveyed while being brought into close contact with a common electrode at the position opposed to the ink ejecting electrodes.

As means for conveying the recording medium, there are a method in which the recording medium is wound around a roll and a method which uses a component capable of keeping the recording medium in close contact with the common electrode. However, both methods require the provision of separate components, so there arises the problem that the printers become complicated in structure.

The present invention has been accomplished for attaining or solving at least one of the above-mentioned problems.

To be more specific, it is an object of the present invention to keep he spacing between ink ejecting electrodes and a recording medium constant easily during conveyance of the recording medium, thereby to stabilize an electric field between the electrodes and the recording medium and hence stabilize the amount of ink to be ejected.

It is another object of the present invention to prevent the leakage of ink by feeding the ink at a stable pressure to ink ejecting electrodes and thereby prevent the portions around the electrodes from being clogged with the ink.

It is a further object of the present invention to accommodate a printing head composed of an ink tank and an ink circulating path compactly in a printer, to thereby reduce the size of the printer.

According to the present invention there is provided an ink jet printer comprising a recording medium conveying portion for conveying a recording medium, a head portion which causes ink to be ejected onto the recording medium conveyed by the conveying portion while allowing a colorant component contained in the ink to be aggregated on ink ejecting electrodes under the action of an electrostatic field, and a fixing portion for fixing an image printed by the head portion, the head portion causing the ink to be ejected below the horizontal level.

According to an embodiment of the head portion, the head portion comprises an ink chamber for the storage therein of ink with a colorant dispersed in a solvent, an ink circulating portion for circulating the ink from the ink chamber, and an ink ejecting portion having ink ejecting electrodes for ejecting the ink to the recording medium, with the ink being fed to the ink ejecting electrodes from the ink circulating portion, the ink ejecting electrodes ejecting the ink toward counter electrodes opposed to ink ejecting electrodes under the action of an electrostatic field, the ink chamber being provided above the ink circulating portion, and the ink ejecting portion being provided below the ink circulating portion, thereby permitting the ink to be fed from the ink chamber to the ink ejecting electrodes under the action of gravity.

Preferably, the ink circulating portion is provided with an ink sump portion for storing an appropriate amount of ink from the ink chamber, an ink flow control chamber for controlling the flow rate of ink and feeding the ink to the ink ejecting portion, and a pump portion for circulating the ink.

Preferably, the pump portion is provided with means for feeding ink to the ink ejecting electrodes and means for recovering the ink from the electrodes, and the ink sump portion is provided with colorant concentration detecting means for detecting the concentration of circulating ink.

Preferably, an uneven structure is provided on a wall surface by subjecting to labyrinth processing of an opening portion of the ink ejecting portion on the side opposite to the ink ejecting electrodes to increase the surface area.

Preferably, an ink-repellent substance is applied to tip end portions of the ink ejecting electrodes arranged in the opening portion of the ink ejecting portion and also to an ink flow path located near the opening portion.

BEST MODE FOR CARRYING OUT THE INVENTION

Figure 1:
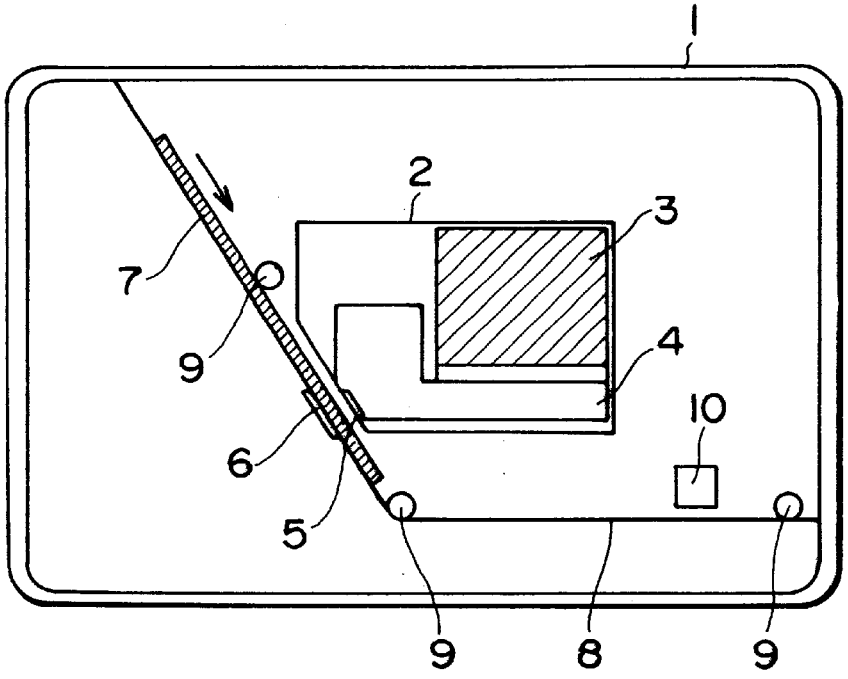
FIG. 1 is a longitudinal sectional side view showing an ink jet printer according to an embodiment of the present invention.

FIG. 1 illustrates an ink jet printer according to an embodiment of the present invention. In the figure, the reference numeral 1 denotes a housing, numeral 2 denotes a printing head, numeral 3 denotes an ink tank for replenishment, numeral 4 denotes an ink circulating system, numeral 5 denotes an ink ejecting portion, numeral 6 denotes a common electrode, numeral 7 denotes a recording medium, numeral 8 denotes a recording medium conveying path, numeral 9 denotes a recording medium conveying device, and numeral 10 denotes a fixing unit.

The printing head 2 is provided with a large number of ink ejecting electrodes. The ink ejecting electrodes are arranged at appropriate intervals so that the direction of the arrangement is perpendicular to a conveying direction of the recording medium 7. The ink ejecting electrodes are arranged in plural rows to constitute the ink ejecting portion 5. In this case, the electrodes are arranged in a zigzag fashion to improve the dot density. The recording medium conveying device 9 is driven by a motor (not shown) to convey the recording medium 7 on the recording medium conveying path 8. The fixing unit 10 fixes a toner image printed on the recording medium 7. A common electrode 6 is disposed at the position where the ink ejecting electrodes and the recording medium conveying path 8 are opposed to each other so that a constant voltage (bias voltage) can be applied between the ink ejecting electrodes of the printing head 2 and the common electrode. The printer is driven so that a recording voltage which has been subjected to a pulse width modulation in accordance with an image signal is imposed on an ink ejecting electrode, whereby a colorant component contained in the ink being circulated through the ink circulating system 4 is ejected. The ink flying direction is lower than the horizontal level. The colorant component corresponding to the ejected colorant component is replenished from the ink tank 3.

For example, the ink used comprises a petroleum-based solvent, such as isoparaffin of a low viscosity (about 1 to 10 mPa·s), and an electrically charged pigment dispersed in the solvent together with an electric charge controlling agent.

Regarding how to circulate the ink and the configuration of the printing head 2, a detailed description will be given later.

The recording medium conveying device 9 operates to convey the recording medium 7 linearly with use of rollers or the like disposed upstream and downstream of the common electrode 6. In this case, the recording medium 7 faces down on its side not to be inked. Since the recording medium 7 can be conveyed while being pushed against the recording medium conveying path 8 by the recording medium conveying device 9, the spacing (about 1 mm) between the ink ejecting electrodes and the recording medium 7 can be kept constant.

In the case where the ink ejecting direction is the horizontal direction or a direction elevated relative to the horizontal level, the spacing between the ink ejecting electrodes and the recording medium 7 is apt to change due to gravity acting on the recording medium 7, thus making it difficult to stabilize the amount of ink to be ejected.

In this embodiment, however, since the ink ejecting direction is lower than the horizontal level, it is possible to stabilize the amount of ink to be ejected.

The following description is now provided concerning the configuration of the printing head.

Figure 2:
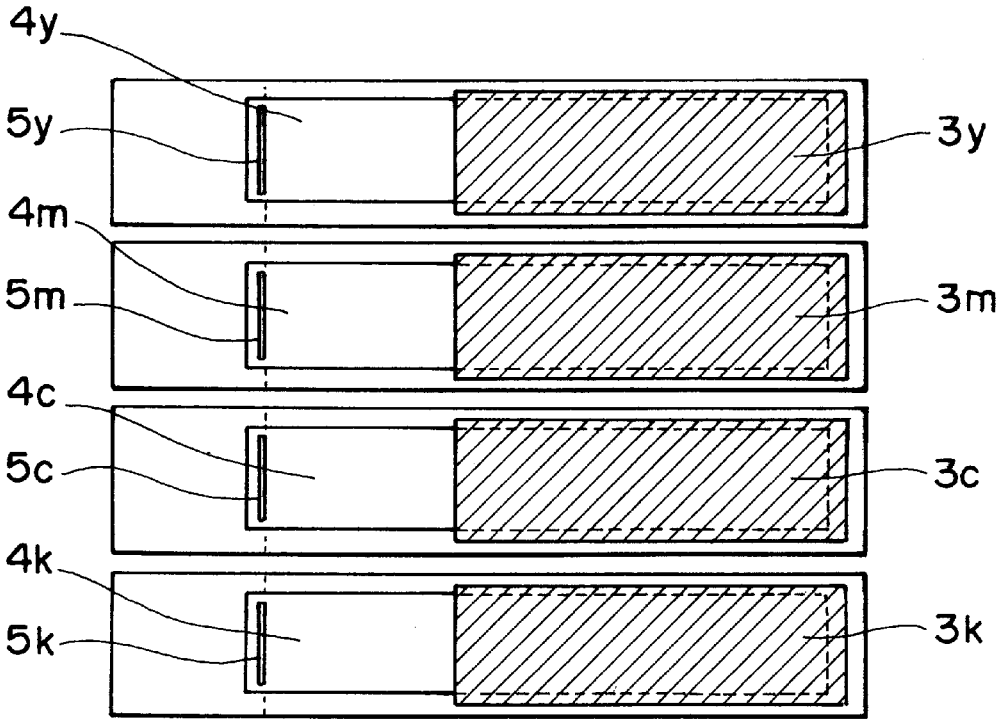
FIG. 2 is a top view showing an example of a printing head used in the ink jet printer illustrated in FIG. 1.

FIG. 2 is a diagram of the printing head 2 as seen from above in FIG. 1. The printing head 2 comprises heads for four colors, which are yellow, magenta, cyan, and black, which heads are arranged side by side. During image printing, ink is ejected with a pulse voltage which is applied in accordance with an image signal while the heads are moved across the recording medium by means of a carriage.

The ink consumed by printing is replenished to the ink circulating system 4*f* rom the ink tank 3. The ink tank 3 is a cartridge which can be replaced.

Figure 3:
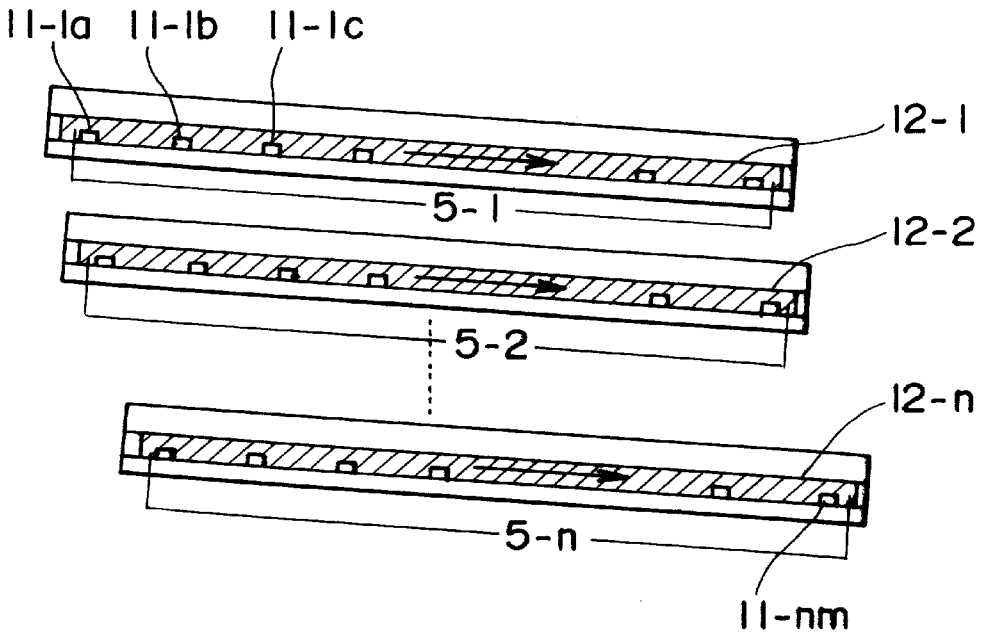
FIG. 3 is a front view of an ink ejecting portion of the printing head shown in FIG. 2.

FIG. 3 is a diagram showing an ink ejecting portion 5 for one color in the printing head 2 as seen from the common electrode side in FIG. 1.

The ink circulating path 12 is divided into plural paths, with a large number of ink ejecting electrodes 11 being present in each ink circulating path 12. The ink circulating path 12 is inclined so that the ink flows from above to below. This inclination is for preventing the ink flowing velocity from being decreased by a flow path resistance induced during ink flow. The angle of the inclination is determined according to the material of the flow path and the viscosity of the ink used. It is necessary that the ink ejecting electrodes 11 be spaced apart several hundred $\mu$m from one another to prevent electric discharge between electrodes. But a printing head of a high resolution can be obtained by arranging the ink ejecting electrodes 11 present in the ink circulating path 12 in a zigzag fashion.

Figure 4:
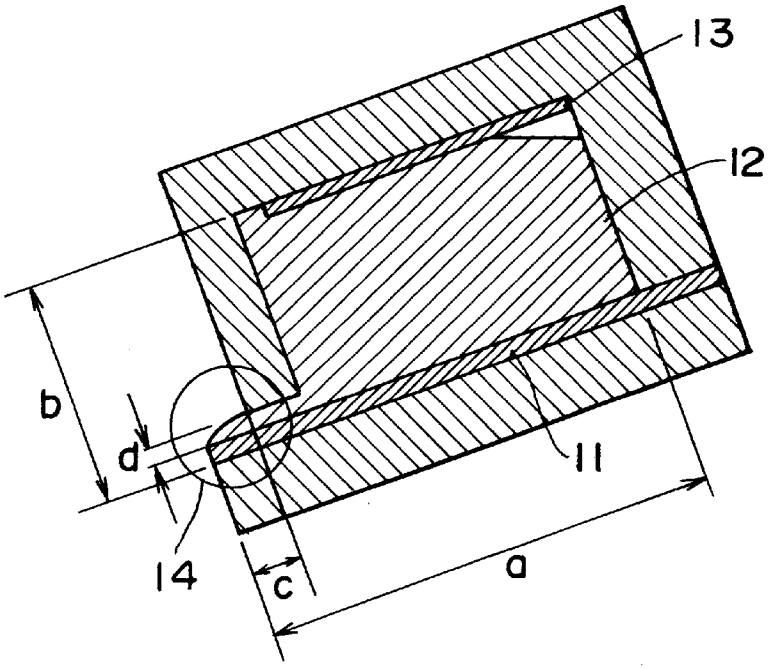
FIG. 4 is a side sectional view of a print head.

FIG. 4 is a sectional view in which the ink circulating path 12 shown in FIG. 3 has been cut at the portion of an ink ejecting electrode 11. An aggregating electrode 13 is present throughout an upper surface of the ink circulating path 12, and on an opposite wall surface there are a large number of ink ejecting electrodes 11. By setting the aggregating electrode 13 at a higher potential than the ink ejecting electrodes 11, a colorant component contained in the circulating ink shifts to the surfaces of the electrodes 11 and aggregates. At this time, by spacing a tip end portion of the aggregating electrode 13 from the wall surface of the ink circulating path 12 which is orthogonal thereto, there is created an electric field component which advances toward tip ends of the ink ejecting electrodes 11, so that the ink which is larger in the degree of aggregation can be fed to the tip ends of the electrodes and can be ejected therefrom. If the ink ejecting electrodes 11 are each set to a width of 30 to 100 $\mu$m and the electrode-to-electrode spacing is set at about 200 to 600 $\mu$m, the ejection of ink from the electrodes 11 becomes stable and there will no longer be any electric discharge between adjacent electrodes 11. If the thickness of each ink ejecting electrode 11 is set at 20 $\mu$m or more, a sufficient difference in height is formed on the ink circulating path 12, so that the adhering force of the ink to the surface of the ink circulating path becomes weak and therefore it becomes easier for the ink to fly out from the tip ends of the ink ejecting electrodes 11.

An opening portion 14 located near the tip end of each ink ejecting electrode 11 is narrow, and so there is little flow of ink despite the opening portion 14 being a part of the ink circulating path 12. Only when voltage is applied to each ink ejecting electrode 11 will the ink be drawn to near the opening portion 14 by an electric field and wet the tip end of the electrode 11. The length "a" of each ink ejecting electrode 11 is 1 to 3 mm and the distance "b" between the aggregating electrode 13 and the ink ejecting electrode 11 is 200 to 500 $\mu$m. The larger the values of "a" and "b," the larger the amount of ink to be circulated, thus causing the problem that the amount of waste ink increases. On the other hand, if the value of "a" is set too small, there arises the problem that the aggregation degree of ink at the tip end of each ink ejecting electrode 11 becomes lower because of a small area which contributes to the aggregation of ink induced by an electrostatic field. If the value of "b" is set too small, there arises the problem that the flow path is blocked with ink which has aggregated and become higher in viscosity. It follows that there is an appropriate range with respect to the flow path size.

Further, the length "c" of the narrow portion in the vicinity of the tip end of each ink ejecting electrode 11 is set at 0.2 to 0.5 mm and an opening width "d" is set at 0.1 to 0.3 mm. These sizes are determined to obtain a balance between the prevention of ink leakage and the prevention of obstruction to the ink ejection. Appropriate values are determined taking the viscosity and surface tension of the ink being used into account.

In accordance with the present invention, since the opening portion of the ink circulating path faces downward with respect to a horizontal level, the leakage of ink is apt to occur from the opening portion. Therefore, it is necessary to take some measures for the prevention of ink leakage in addition to decreasing the area of the opening portion such as that referred to above.

Figure 13:
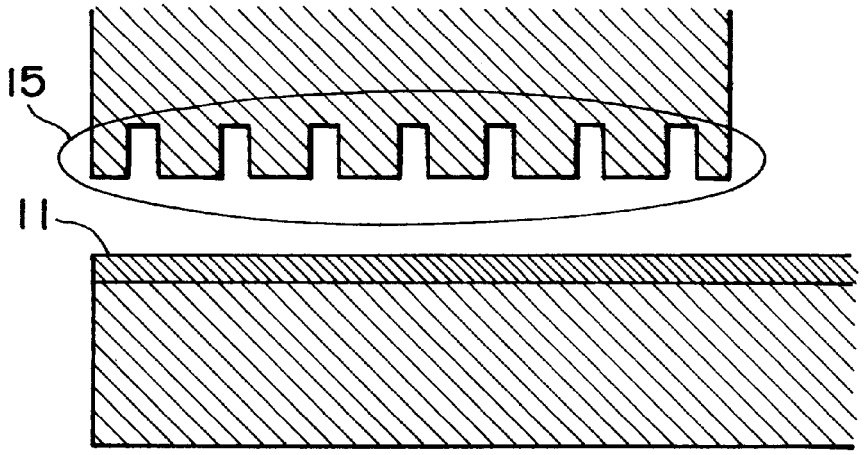
FIG. 13 is a diagram showing a sectional shape of the ink ejecting portion.

FIG. 13 is an enlarged diagram of the opening portion 14 shown in FIG. 4. A labyrinth structure is formed in the opening portion 14 on the side opposed to the ink ejecting electrodes 11. This periodic uneven structure increases the surface area, so that it becomes difficult for the ink to leak from the opening portion due to a surface tension acting thereon. In addition, it is preferable that the surface of the ink circulating path 12 be treated for adjusting the wettability of the ink. How to effect this treatment, as well as an ink ejecting method, will be described later.

Figure 5:
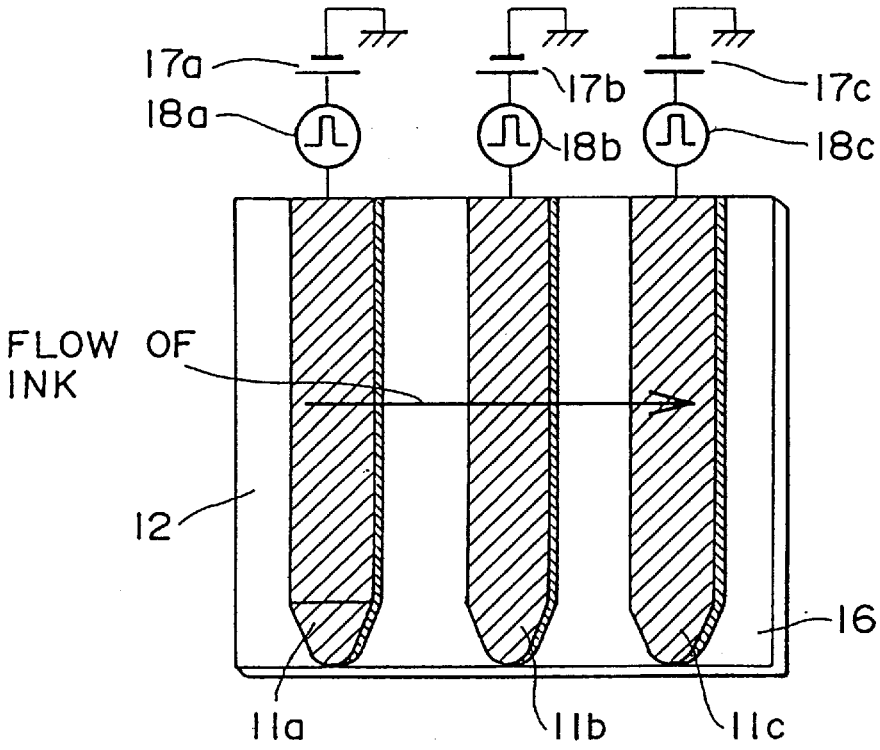
FIG. 5 is a diagram showing ink ejecting electrodes used in the printing head shown in FIG. 2.
Figure 11:
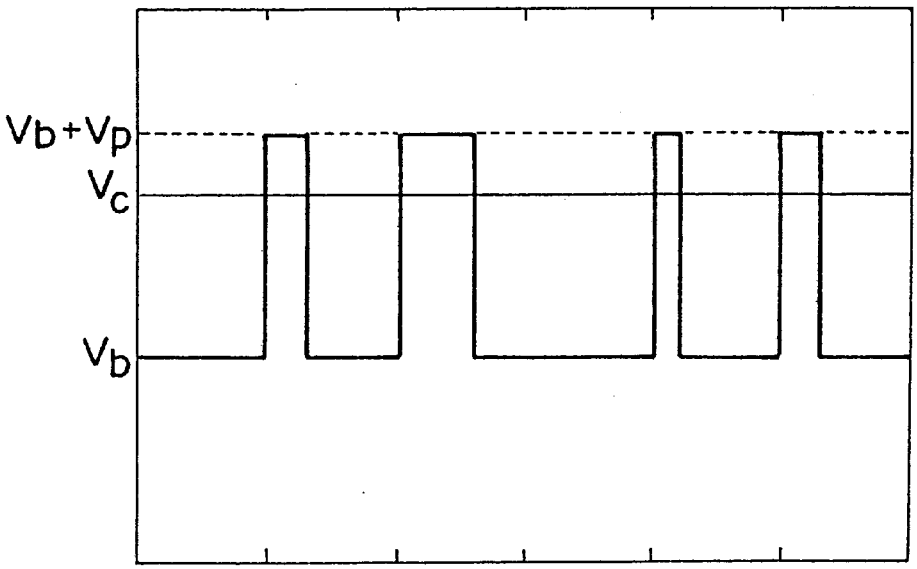
FIG. 11 is a diagram showing voltages applied to a printing head constructed according to the present invention.

FIG. 5 is a diagram obtained by viewing the opening portion 14 shown in FIG. 4 from above. In the figure, ink ejecting electrodes 11 are arranged perpendicularly to the ink flowing direction, and a bias power supply 17 and a pulse power supply 18 are connected to each of the ink ejecting electrodes 11. The bias power supply 17 is set at a voltage Vb (2 to 3 kV) smaller than the voltage at which ink flies to the common electrode, while the pulse power supply 18 is set at a voltage Vp of 200V to 800V. FIG. 11 shows a relation to a voltage Vc which is applied to the foregoing aggregating electrode. By setting Vc larger than Vb the electric field is directed from the aggregating electrode toward the ink ejecting electrodes to supply aggregated ink to the ink ejecting electrodes. A relation of magnitude between Vc and Vb+Vp is determined according to what type of ink is used and the size of the ink circulating path.

In such a voltage setting, if an ink-repellent substance is applied to the flow path near the opening portion, the ink is repelled away from the tip end of each ink ejecting electrode when no ejecting voltage pulse is applied, while upon application of such a voltage pulse the ink is repelled in an ejecting direction from the ink ejecting electrode. Thus, without leakage of ink from the opening portion, the ink can be ejected efficiently by turning on and off the voltage pulse.

A highly ink repellent substance is determined according to a surface tension of the ink used. For the ink used in the present invention, it is desirable to use a fluoric resin as such an ink repellent substance.

Reference will be made below to an ink circulating method for preventing the occurrence of ink leakage.

Figure 6:
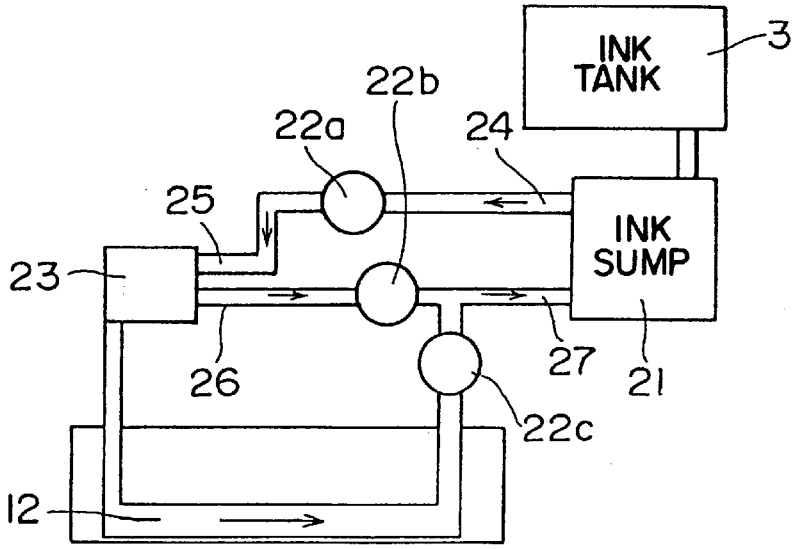
FIG. 6 is a diagram showing an ink circulating system used in the ink jet printer according to the present invention.

FIG. 6 illustrates the configuration of an ink circulating system. In the figure, ink stored in an ink sump 21 is fed to an ink flow control chamber 23 through ink circulating paths 24 and 25 by virtue of the suction force of a pump 22*a*. Due to a difference in potential energy caused by a difference in height between the ink flow control chamber 23 and the ink circulating path 12, the ink which has entered the ink flow control chamber 23 flows to the ink circulating path 12 in which ink ejecting electrodes are arranged. A portion of the ink is discharged from the ink flow control chamber 23 by means of a pump 22*b* to keep constant the liquid level in the ink flow control chamber 23. The ink discharged from the ink flow control chamber 23 passes through ink circulating paths 26 and 27 and returns to the ink sump 21. This configuration will be described below in more detail with reference to FIG. 8.

To start printing, the circulation of ink is started by means of a pump 22. As the ink enters the ink flow control chamber 23 through the ink circulating path 25, the liquid level in the chamber rises gradually. If the ink is discharged in an appropriate amount by means which discharges the ink from the ink flow control chamber 23 while the ink level is detected by an ink level detector 32, it is possible to keep constant the difference in height between the ink level and the position where the ink ejecting electrodes are present. That is, the ink level is kept constant while adjusting the output of the pumps 22*a* and 22*b*. By keeping such difference in height constant it is possible to keep constant the pressure of the ink fed to the ink ejecting electrodes. In this state printing is started.

In case of discharging the ink from the ink flow control chamber 23, the ink should be discharged from near the bottom of the ink flow control chamber 23, whereby it is possible to prevent stagnation of the ink in the same chamber.

Even where a colorant component contained in the ink precipitates on the bottom of the ink flow control chamber 23, it is possible to recover the sediment. By passing the ink through a filter in the ink circulating path the sediment can be recovered on the filter, and by replacing the filter periodically it is possible to effect a stable printing.

Since in this embodiment the opening surface with the ink ejecting electrodes arranged thereon faces downward relative to a horizontal level, it is important to control the ink pressure near the ink ejecting electrodes so as not to cause the leakage of ink.

Reference will now be made to an example of the ink level detector 32 used in the present invention. Two electrodes are erected vertically so as to admit ink therebetween and a change in resistance between both electrodes, which occurs according to a change in ink level, is detected to detect the current ink level. A certain ink exhibits an increase in viscosity as the ink temperature drops. As the viscosity increases, the flow path resistance in the ink circulating path increases and the ink becomes difficult to flow. Therefore, in case of using an ink whose viscosity varies with temperature, it is desirable, for eliminating a change in flow path resistance caused by an increase or decrease of viscosity, to effect a control involving detecting the ink temperature or the internal temperature of the printer, changing the ink level in the ink flow control chamber 23 in accordance with the detected temperature, and changing the pressure of the ink to be fed to the ink ejecting portion.

Figure 7A:
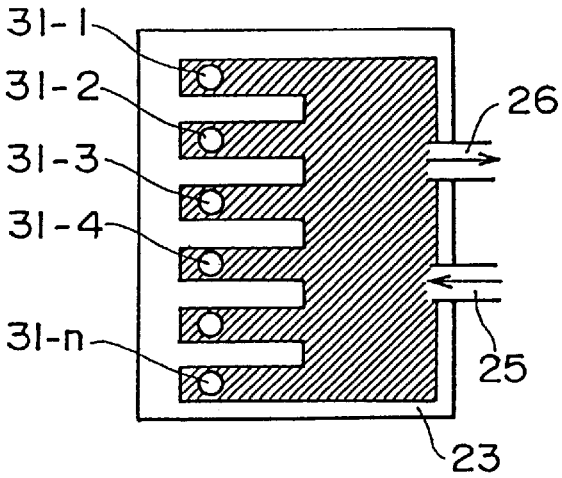
FIGS. 7A and 7B are top views of respective examples.
Figure 7C:
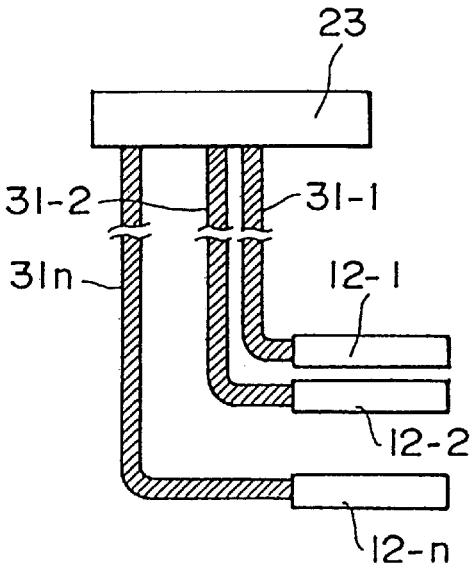
FIGS. 7C and 7D are diagrams showing in what manner the ink flow rate is controlled by the ink circulating system illustrated in FIG. 6.
Figure 7B:
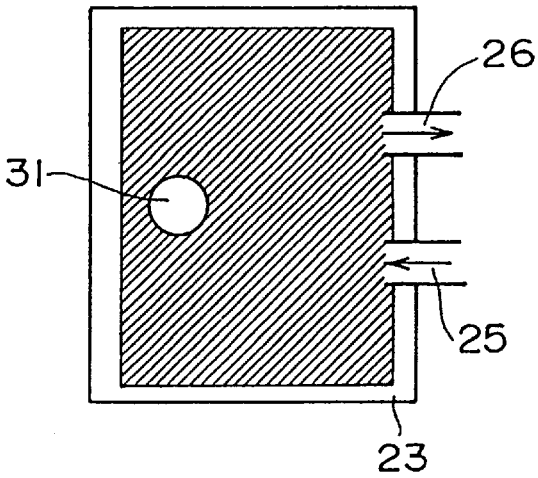
Figure 7D:
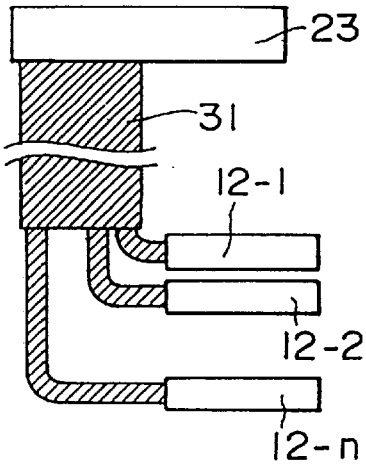

FIGS. 7A and 7B comprise top views of respective examples the ink flow control chamber 23 shown in FIG. 6 and FIGS. 7C and 7D are diagrams showing the flow path configurations of these examples from the ink flow control chamber 23 up to the ink circulating path 12, including rows of ink ejecting electrodes.

FIG. 7A shows an example in which an ink circulating path 31 in the ink flow control chamber 23 branches according to the number of ink circulating paths 12 with ink ejecting electrodes arranged therein. The ink which has entered the ink circulating path 31 passes through the ink circulating paths 12 with ink ejecting electrodes arranged therein and is returned to the ink sump 21 by the suction force of the pump 22*c*. In this case, by providing suction with the pump 22*c* so that the ink pressure acting in the direction of the opening surface from the interior of the ink circulating path 12 becomes lower than the atmospheric pressure, it is possible to prevent ink leakage from the opening portion of the ink circulating path 12.

In FIG. 7B, the ink from the ink flow control chamber 23 enters one ink circulating path 31 and branches just before a plurality of ink circulating paths 12 with ink ejecting electrodes arranged therein. The branching is made so as to give an equal ink flow rate in n number of ink circulating paths 12.

In the ink jet printer being considered, ink is circulated with a pump, so for preventing the leakage of ink in the opening portion it is necessary to establish a pump actuating sequence, which sequence will be described below.

When the user switches on the power supply for starting the operation of the ink jet printer, the circulation of ink is started. At this time, the pumps 22*a*, 22*b* and 22*c* start operating simultaneously. During printing, the pump 22*c* operates at a constant flow rate, but the outputs of the pumps 22*a* and 22*b* vary to effect adjustment of the ink level in the ink flow control chamber. When printing is to be terminated, the pump 22*a* is the first to stop, then the pumps 22*b* and 22*c* are turned off after the ink present in the ink circulating path has been recovered completely into the ink sump 23. With such a control, there is no fear of ink leakage from the opening portion while the printer is off.

Figure 8:
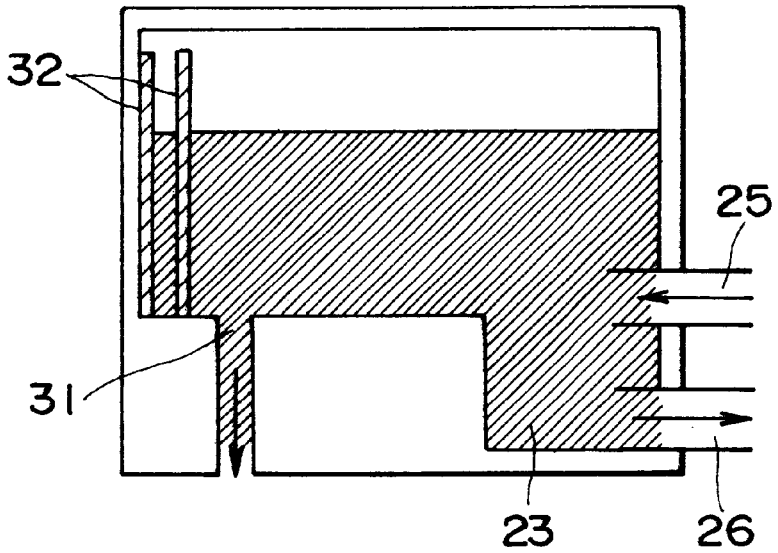
FIG. 8 is a diagram showing in what manner the ink flow rate is controlled by the ink circulating system illustrated in FIG. 6.
Figure 9:
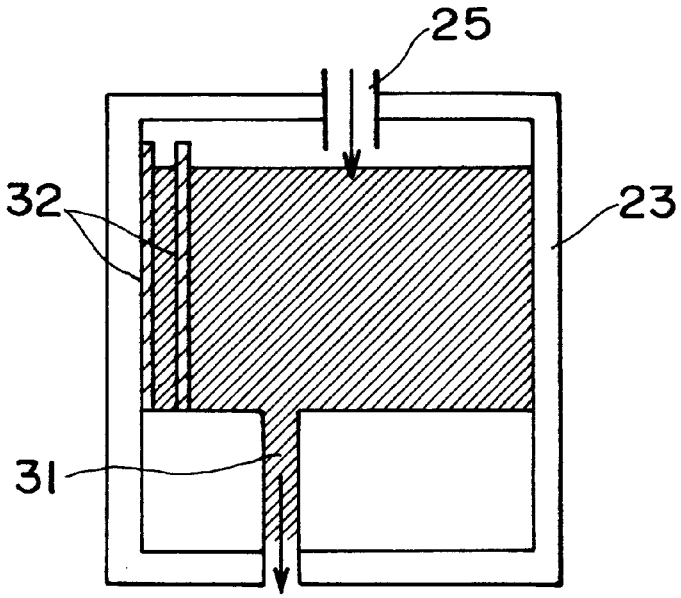
FIG. 9 is a diagram showing a method different from the method illustrated in FIG. 8, which method is for controlling the ink flow rate with use of an ink circulating system.

FIG. 9 shows a method for adjusting the ink level in a flow control chamber 23 in a manner different from that illustrated in FIG. 8. Since this configuration is for ink admission only, it does not require the pump 22*b* shown in FIG. 6, thus permitting the reduction in the number of pumps being used.

However, it is necessary that a pump much smaller in size and lower in output than the pump used in the configuration of FIG. 8 be used as the pump 22*a* for conveying ink to the ink flow control chamber. This requirement sometimes results in an increase in the manufacturing cost. Which of the configuration of FIG. 9 using two large and small pumps and the configuration of FIG. 8 using the same three pumps is to be adopted depends on the size of the ink jet printer to be obtained and the manufacturing cost, which varies according to the number of the printers to be manufactured.

The pump operating method is the same as in the example shown in FIG. 8.

Since the ink jet printer of the present invention is of the type wherein ink is circulated and aggregated ink is ejected, the pigment concentration in the ink adhered onto the recording medium is higher than that of the circulating ink. Consequently, the pigment concentration becomes lower as the image printing is continued, thus requiring the replenishment of the ink having the original concentration.

The ink being circulated usually contains several % of a pigment component, but as this concentration becomes lower, not only is the image quality in printing deteriorated, but also the ink viscosity lowers or an electric resistance increases, resulting in a state wherein the adjustment in the ink flow control chamber becomes inappropriate. Therefore, in the event the flow rate of ink fed to the ink ejecting portion varies and increases, there may occur ink leakage from the opening portion. In the ink jet printer of the invention, since a petroleum-based liquid is used as the solvent, the solvent may evaporate with consequent increase of the ink concentration if the printer is not used over a long period.

Also, in this case, the adjustment in the ink flow control chamber becomes inappropriate and therefore the ink can no longer be circulated at an appropriate pressure. To avoid this inconvenience, it is necessary to detect a pigment concentration in the ink and effect a control to replenish the ink from the ink tank if the pigment concentration is low, or decrease the concentration if the concentration is high. How to control the pigment concentration in the ink will be described below.

Figure 10:
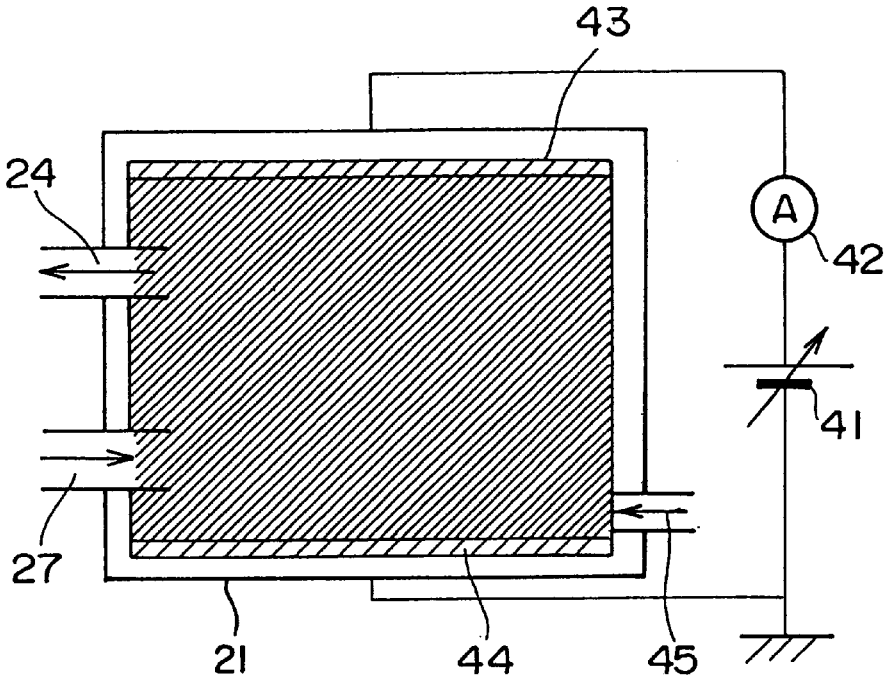
FIG. 10 is a diagram showing how to adjust the ink concentration in an ink circulating system for use in the ink jet printer according to the present invention.

FIG. 10 is a sectional view of the ink sump 21. As explained previously with reference to FIG. 6, the ink present in the ink sump 21 is circulated by means of plural pumps. Electrodes 43 and 44 are provided on the inner wall of the ink sump 21 so that a voltage provided from a power supply 41 can be applied between both electrodes. Since the larger the amount of the pigment component contained in the ink is, the lower the electric resistance of the ink will be, an ink concentration can be determined by detecting, with a voltmeter 42, an electric current flowing upon application of the voltage to the electrodes 43 and 44. If the detected ink concentration is low, the ink from the ink tank 3 is replenished by gravity from an ink introducing portion 45. Conversely, if the detected ink concentration is high, the voltage remains applied to the electrodes 43 and 44, allowing the ink to be aggregated onto the surface of the electrode 44, thereby decreasing the ink concentration, and by diminishing the applied voltage according to the consumption of ink or by stopping the application of voltage, the pigment component is released into the ink. The electrode for decreasing the ink concentration may be disposed at another position in the ink circulating system. Further, a tank containing only the solvent may be provided for replenishment of the solvent to the ink circulating system.

Figure 14:
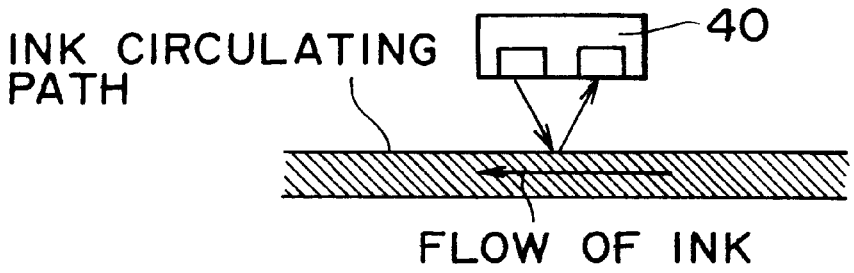
FIG. 14 is a diagram showing an ink concentration detecting method used in the present invention.

FIG. 14 illustrates another method for detecting the ink concentration. According to this method, the ink circulating path is formed using a transparent pipe, light is radiated to the ink flowing through the pipe, and an ink concentration is detected on the basis of reflectance of the light. According to another method which utilizes light, light is transmitted through the ink flowing in the pipe and an ink concentration is detected from the transmittance of the light.

The above methods of detection of pigment concentration and concentration control need not be performed continually, in the case of a printer where the ink concentration does not change abruptly, but may be performed with a suitable period.

The following description is now provided about how to fabricate the ink ejecting portion in the printing head shown in FIG. 4.

First, an ink ejecting electrode substrate may be fabricated, for example, by a method wherein rows of ink ejecting electrodes having a predetermined width and feeder patterns connected to the electrodes are formed on a substrate such as a ceramic, glass or resin substrate by vapor deposition or any other suitable means, or a method wherein a metallic film formed on the surface of the above substrate is etched to form rows of ink ejecting electrodes and feeder patterns, or a method wherein a thin metal foil is etched to form rows of ink ejecting electrodes and feeder patterns and is then bonded onto the substrate by anodic bonding or by using a thermosetting epoxy resin.

Figure 12:
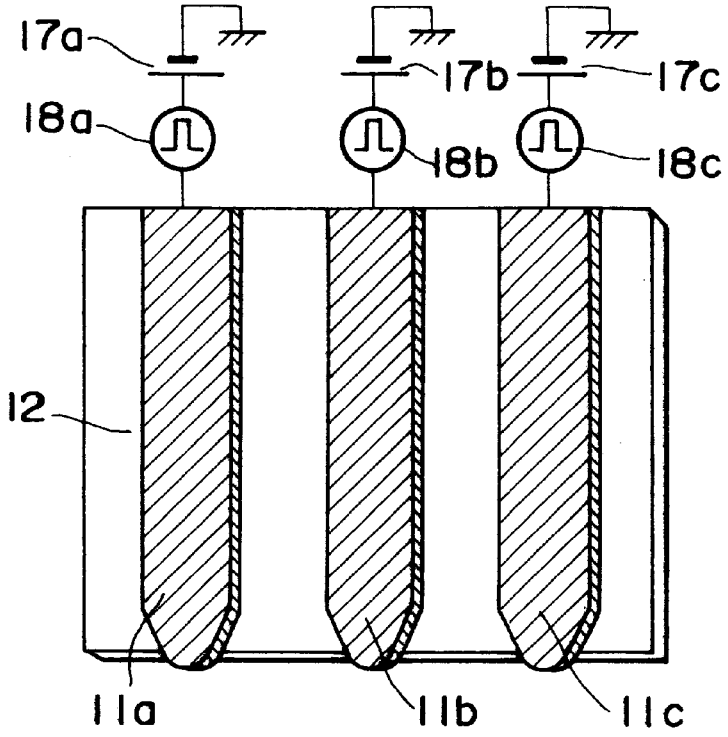
FIG. 12 is a diagram showing ink ejecting electrodes in a printing head having a configuration different from that illustrated in FIG. 5.

In the method using a metal foil, the electrodes can be formed so that their tip ends are projected from the substrate as in FIG. 12. According to this configuration, the ink present at the electrode tip is no longer in contact with the substrate, so that the ink ejecting voltage can be decreased. Separately from this ink ejecting substrate, an aggregating electrode of several $\mu$m is formed by vapor deposition or electroless plating onto one side of a ceramic member which has been formed in a turned square U-shape by molding. These two members are bonded together by anodic bonding or by using a thermosetting epoxy resin to form an ink ejecting portion. Such ink ejecting portions are bonded together in a multi-layer fashion to fabricate the whole of a head.

Now, the configuration of another printing head different from that shown in FIG. 4 will be described below with reference to FIGS. 15 to 17.

Figure 15:
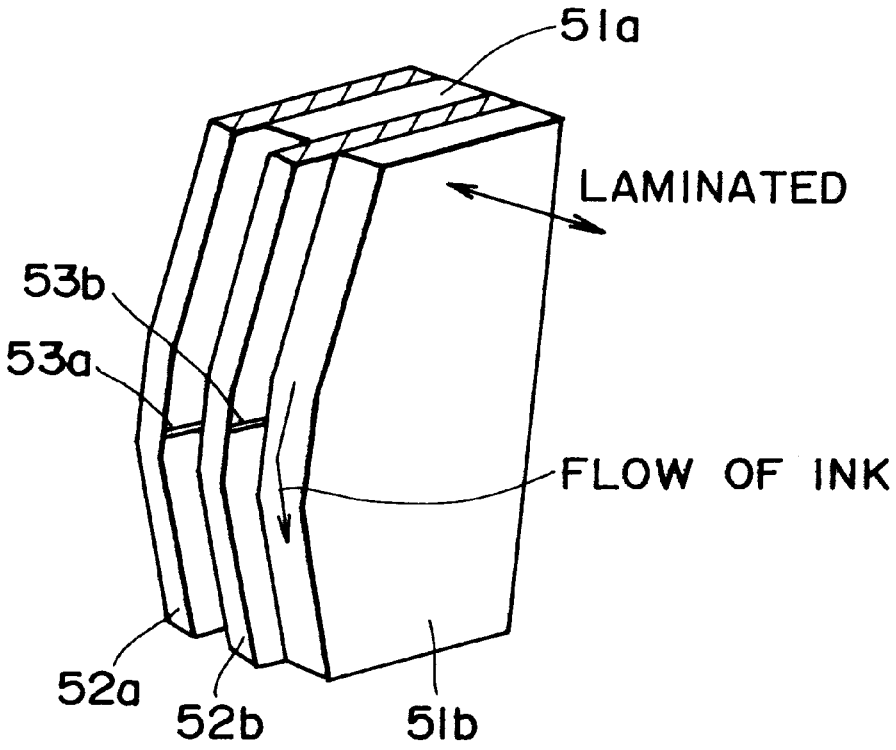
FIG. 15 is a perspective view showing the configuration of a printing head for use in the ink jet printer illustrated in FIG. 1.

FIG. 15 is a diagram showing the configuration of an ink ejecting electrode row and that of an ink circulating path in the printing head.

This printing head has a structure in which electrode substrates 52 each formed with an ink ejecting electrode 53 on the surface thereof and a spacer 51 are laminated in an alternating manner. The method for fabricating the electrode substrates 52 may be the same as the method for forming a row of ink ejecting electrodes shown in FIG. 4. Ink flows in the directions of arrows in the figure along the turned square U-shaped portion surrounded by the two electrode substrates 52 and the spacer 51. The surface (a wall surface of an ink circulating path) of the spacer 51 in contact with the ink is a curved surface. An outer periphery of each electrode substrate 52 is also in the same shape as the outer periphery of the spacer 51.

As in the printing head shown in FIGS. 3 and 4, means for feeding ink to the ink ejecting electrodes and means for recovering the ink from the electrodes are connected to the printing head, and the tip ends of the ink ejecting electrodes 53 are directed lower than a horizontal level, whereby the ink can be ejected in the direction in which the tip ends of the electrodes 53 face.

Figure 16:
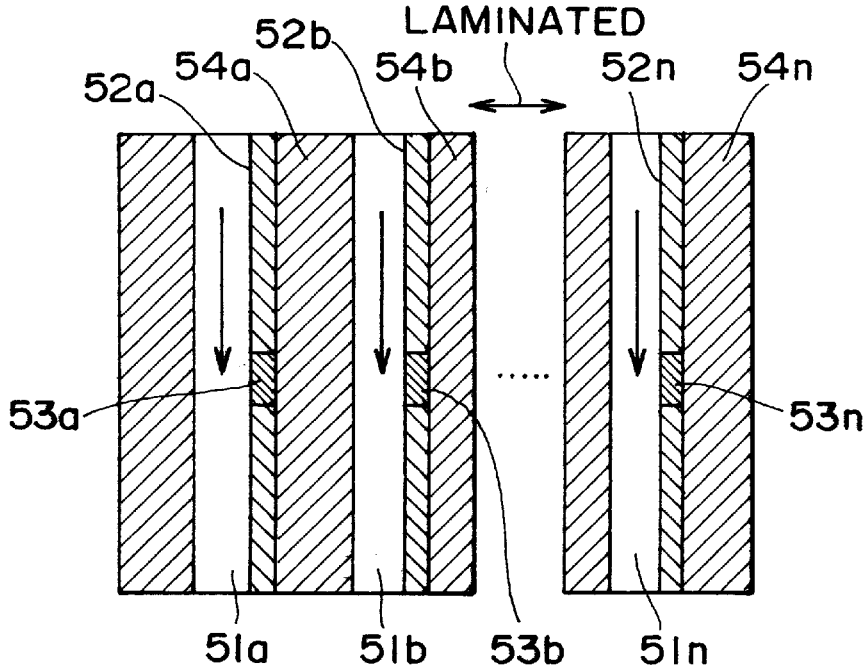
FIG. 16 is a front view of an ink ejecting portion in the printing head shown in FIG. 15.

FIG. 16 is a diagram in which the ink ejecting portion shown in FIG. 15 is viewed from a common electrode side.

In FIG. 16, the numeral 54 denotes an adhesive layer for bonding the spacer 51 and the electrode substrate 52 adjacent to each other. The ink ejecting electrodes shown in the figure are about 0.1 mm in width. The vicinity of each ink ejecting electrode is a portion which is open to the atmosphere over a length of about 1 to 3 mm.

The sum of the thickness of each ink ejecting electrode 53 and that of the spacer 51 corresponds to the width of the ink circulating path. Where an open surface is directed right beneath in a connected state of the ink circulating system thereto, a flow path width of the open surface which permits a leak-free circulation of the ink depends on the surface tension and viscosity of the ink.

In case of the ink (surface tension: 20 dyne/cm or so, viscosity: 1 to 10 mPa·s or so) used in the present invention, the flow path width is 0.1 to 0.3 mm. Where the open surface is made vertical, there is no fear of ink leakage even if the flow path width is 1 mm or so. Thus, the flow path width not causing ink leakage depends on the direction of the open surface. However, broadening the flow path width will result in deteriorated resolution of the printing head, so the flow path width is preferably set in the range of 0.1 to 0.2 mm.

It is necessary that the thickness of the ink ejecting electrode formed on each electrode substrate 52 be not smaller than 20 $\mu$m. If the thickness is smaller than 20 $\mu$m, the ink has difficulty in leaving the surface of the electrode substrate 52 under the surface tension of the ink when the ink is to be ejected, thus making the ejection of the ink difficult. The thickness of the spacer is determined according to the thickness of the ink ejecting electrode.

Figure 17:
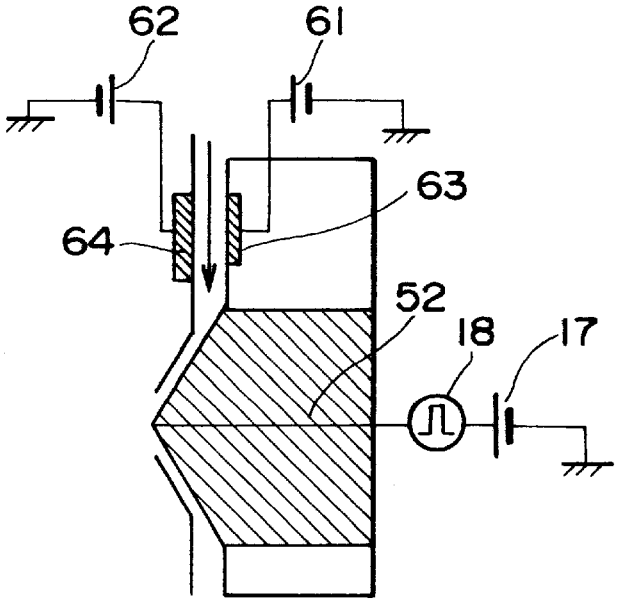
FIG. 17 is a diagram showing a power supply for the application of a voltage to the printing head illustrated in FIG. 15.

FIG. 17 is a diagram showing an arrangement of the printing head illustrated in FIGS. 15 and 16 and a power supply disposed just before the printing head for the application of voltage to the ink circulating path.

Ink passes between a first control electrode 63 and a second control electrode 64 and advances to the printing head fabricated by laminating electrode substrates and spacers. While the ink jet printer is in operation, a voltage is applied to the first and second control electrodes 63, 64 and a bias voltage is applied to both ink ejecting electrodes 52 continually, so that ink flows under the action of an electrostatic field. The direction of the electric field is made coincident with the ink flowing direction so that an electrically charged colorant contained in the ink is aggregated at the tip ends of the ink ejecting electrodes 52. The operation of a bias power supply 17 and that of a pulse power supply 18 both connected to the printing head are the same as in the printing head illustrated in FIG. 4.

The following description is now provided about how to set the magnitude of the voltage in each power supply.

First, a bias voltage is set for the bias power supply 17. There is applied a bias voltage (2 to 3 kV) at which the ink flows, but is not ejected. Thereafter, a voltage higher by 100 to 200V than the bias voltage is applied to the first control electrode, while a voltage intermediate between both voltages is applied to the second control electrode.

As a result, an electric field advances from the two control electrodes toward the ink ejecting electrodes 22 and also advances from the bottom of the ink flowing path toward the open surface, so that the colorant component contained in the ink aggregates most at the tip ends of the ink ejecting electrodes 52 under the action of an electrostatic force. In this state, a pulse voltage is applied in accordance with a recording signal, whereby the aggregated ink can be ejected onto the recording medium.

As set forth above, the ink jet printer according to the present invention is useful in printing pictures and characters with a high accuracy by the ejection of ink droplets. In particular, the ink jet printer according to the present invention is suitable for use as a color ink jet printer of a small size and low cost.

What is claimed is:

1. An ink jet printer comprising:

a recording medium conveying portion;

a head portion, the head portion comprising an ink chamber for storing an ink which comprises a solvent and a colorant dispersed therein, an ink circulating portion for circulating the ink from the ink chamber, and an ink ejecting portion having ink ejecting electrodes for ejecting the ink to the recording medium, with the ink being fed to the ink ejecting electrodes from the ink circulating portion, the ink ejecting electrodes ejecting the ink toward counter electrodes opposed to the ink ejecting electrodes under the action of an electrostatic field; and a fixing portion for fixing an image which has been printed on the recording medium by the head portion;

wherein the ink chamber is disposed above the ink circulating portion and the ink ejecting portion is disposed below the ink circulating portion; and said ink circulating portion having one ink chamber and another ink chamber, and having a first ink circulating path from said one ink chamber to said another ink chamber and having said ink ejecting electrodes disposed therealong, and having a second ink circulating path for returning the excess ink from said one ink chamber to said another ink chamber.

2. An ink jet printer according to claim 1, wherein the ink ejecting portion is tilted in a direction lower than a horizontal level for ejecting the ink.

3. An ink jet printer according to claim 1, where said second ink circulating path is used to keep an ink level substantially constant within said one ink chamber, such that said ink level has a substantially constant height above said ink ejecting electrodes so as to keep an ink pressure of said ink at said ink ejecting electrodes substantially constant.

4. An ink jet printer comprising:

a recording medium conveying portion;

a head portion, the head portion comprising an ink chamber for storing an ink which comprises a solvent and a colorant dispersed therein, an ink circulating portion for circulating the ink from the ink chamber, and an ink ejecting portion having ink ejecting electrodes for ejecting the ink to the recording medium, with the ink being fed to the ink ejecting electrodes from the ink circulating portion, the ink ejecting electrodes ejecting the ink toward counter electrodes opposed to the ink ejecting electrodes under the action of an electrostatic field; and a fixing portion for fixing an image which has been printed on the recording medium by the head portion;

wherein the ink circulating portion comprises:

an ink sump for storing an appropriate amount of the ink from the ink chamber;

an ink flow control chamber for controlling the flow rate of the ink and feeding the ink to the ink ejecting portion; and a pump portion for circulating the ink; and said ink circulating portion including one ink circulating path from said ink flow control chamber to said ink sump and having said ink ejecting electrodes disposed therealong, and having a second ink circulating path for returning the excess ink from said ink flow control chamber to said ink sump.

5. An ink jet printer according to claim 4, wherein the ink sump has colorant concentration detecting means for detecting the content of the colorant in the ink, and the colorant concentration in the ink is controlled on the basis of the detected concentration.

6. An ink jet printer according to claim 4, wherein the ink flow control chamber has an ink level detecting portion for detecting the ink level, and on the basis of the value detected by the ink level detecting portion the ink level is adjusted by the pump portion.

7. An ink jet printer according to claim 4, wherein the ink is fed from an upper surface of the ink flow control chamber and is discharged from a bottom of the ink flow control chamber.

8. An ink jet printer according to claim 4, wherein the pump portion comprises ink feed means for feeding the ink to the ink ejecting electrodes and ink recovery means for recovering the ink from the ink ejecting electrodes.

9. An ink jet printer according to claim 4, where said second ink circulating path is used to keep an ink level substantially constant within said ink flow control chamber, such that said ink level has a substantially constant height above said ink ejecting electrodes so as to keep an ink pressure of said ink at said ink ejecting electrodes substantially constant.

10. An ink jet printer comprising:

a recording medium conveying portion;

a head portion, the head portion comprising an ink chamber for storing an ink which comprises a solvent and a colorant dispersed therein, an ink circulating portion for circulating the ink from the ink chamber, and an ink ejecting portion having ink ejecting electrodes for ejecting the ink to the recording medium, with the ink being fed to the ink ejecting electrodes from the ink circulating portion, the ink ejecting electrodes ejecting the ink toward counter electrodes opposed to the ink ejecting electrodes under the action of an electrostatic field; and a fixing portion for fixing an image which has been printed on the recording medium by the head portion;

wherein an uneven structure is provided on a wall surface of an opening portion of the ink ejection portion; and said ink circulating portion having one ink chamber and another ink chamber, and having a first ink circulating path from said one ink chamber to said another ink chamber and having said ink ejecting electrodes disposed therealong, and having a second ink circulating path for returning the excess ink from said one ink chamber to said another ink chamber.

11. An ink jet printer according to claim 10, wherein an ink-repellent substance is applied to an ink flow path located near the opening portion of the ink ejecting portion and also to tip end portions of the ink ejecting electrodes arranged plurally in the opening portion.

12. An ink jet printer according to claim 10, where said second ink circulating path is used to keep an ink level substantially constant within said one ink chamber, such that said ink level has a substantially constant height above said ink ejecting electrodes so as to keep an ink pressure of said ink at said ink ejecting electrodes substantially constant.

* * * * *